US006346128B1

(12) United States Patent
DeRosa et al.

(10) Patent No.: US 6,346,128 B1
(45) Date of Patent: Feb. 12, 2002

(54) TWO-CYCLE ENGINE FUEL COMPOSITION AND METHOD FOR USING SAME

(75) Inventors: Thomas F. DeRosa, Wallingford, CT (US); Jeffrey M. Burns, Houston, TX (US); Benjamin J. Kaufman, Hopewell Junction, NY (US); Robert J. Bacchi, Highland, NY (US); Serge A. Cryvoff, Pleasant Valley, NY (US); James R. Ketcham, Salt Point, NY (US)

(73) Assignee: Texaco Inc., White Plains, NY (US)

( * ) Notice: Subject to any disclaimer, the term of this patent is extended or adjusted under 35 U.S.C. 154(b) by 0 days.

(21) Appl. No.: 09/451,130

(22) Filed: Nov. 30, 1999

(51) Int. Cl.[7] ..... C10L 1/22; C10M 133/08
(52) U.S. Cl. ..... 44/424; 44/434; 508/562
(58) Field of Search ..... 44/424, 425, 433, 44/434; 508/562

(56) References Cited

U.S. PATENT DOCUMENTS

| | | | | |
|---|---|---|---|---|
| 4,247,301 | A | * | 1/1981 | Honnen |
| 4,261,704 | A | | 4/1981 | Langdon |
| 4,438,022 | A | * | 3/1984 | Campbell |
| 4,460,379 | A | | 7/1984 | Sweeney et al. |
| 4,526,587 | A | | 7/1985 | Campbell |
| 4,604,103 | A | | 8/1986 | Campbell |
| 4,708,809 | A | | 11/1987 | Davis |
| 4,747,851 | A | * | 5/1988 | Sung et al. |
| 5,112,364 | A | | 5/1992 | Rath et al. |
| 5,213,585 | A | * | 5/1993 | Oppenlaender et al. |
| 5,383,942 | A | | 1/1995 | Su et al. |
| 5,498,353 | A | | 3/1996 | Lin et al. |
| 5,616,811 | A | * | 4/1997 | Vipond et al. ..... 564/505 |
| 5,888,948 | A | | 3/1999 | Meny et al. |

FOREIGN PATENT DOCUMENTS

| | | | |
|---|---|---|---|
| EP | 0100665 | * | 2/1984 |
| EP | 0356725 | * | 7/1990 |
| EP | 0962479 A1 | * | 12/1999 |
| JP | 56076495 A | * | 11/1979 |
| WO | WO9630466 | * | 10/1996 |

* cited by examiner

*Primary Examiner*—Margaret Medley
(74) *Attorney, Agent, or Firm*—Morris N. Reinisch; Dilworth & Barrese

(57) ABSTRACT

A two-cycle engine fuel composition comprising (a) a major amount of a two-cycle engine fuel; (b) a lubricant component; and, (c) a two-cycle engine fuel combustion deposit-inhibiting amount of at least one hydrocarbyl polyoxyalkylene aminoalcohol of the general formula

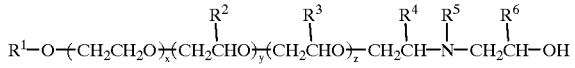

wherein $R^1$ is an alkyl, an alicyclic or an alkylalicyclic radical having from about 4 to about 30 carbon atoms or an alkylaryl where the alkyl group is from about 4 to about 30 carbon atoms; x is an integer from 0 to about 5, y is an integer from 1 to about 49, z is an integer from 1 to about 49 and the sum of x+y+z is equal to 3 to about 50; $R^2$ and $R^3$ each is different and is an alkyl group of from 1 to 4 carbon atoms and each oxyalkylene radical can be any combination of repeating oxyalkylene units to form random or block copolymers; $R^4$ is the same as $R^2$ or $R^3$; $R^5$ is hydrogen or

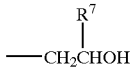

where $R^7$ is hydrogen or an alkyl group of from 1 to 5 carbon atoms and $R^6$ is hydrogen or an alkyl group of from 1 to 5 carbon atoms and methods for using same are provided.

20 Claims, No Drawings

TWO-CYCLE ENGINE FUEL COMPOSITION AND METHOD FOR USING SAME

BACKGROUND OF THE INVENTION

This invention relates to a two-cycle engine fuel composition and method for using same. More particularly, this invention is directed to a two-cycle engine fuel composition containing a two-cycle engine fuel together with a lubricant component and, as a fuel additive, a hydrocarbyl polyoxyalkylene aminoalcohol.

In general, the use of spark-ignited two-cycle (also referred to as two-stroke cycle or 2-stroke) internal combustion engines has steadily increased over the years. These engines have typically been employed in power lawn mowers and other power-operated garden equipment, power chain saws, pumps, electrical generators, marine outboard engines, snowmobiles, motorcycles and mopeds.

Several problems exist with the use of two-cycle engines. Among the problems that are associated with the two-stroke cycle engines are, for example, piston ring sticking, piston scuffing, rusting, lubrication related failure of connecting rod and main bearings and the accumulation of deposits such as carbon and varnish deposits on various parts of the engine, e.g., the combustion chamber and on the fuel intake and exhaust system of the engine. The existence of these problems can affect the performance of the engine. For example, piston ring sticking can lead to failure of the sealing function of piston rings which typically results in loss of cylinder compression. This is particularly damaging in two-stroke cycle engines because many of these engines depend on suction to draw the new fuel charge into the exhausted cylinder. Thus, ring sticking can lead to deterioration of engine performance and unnecessary consumption of fuel and/or lubricant.

The presence of deposits in the combustion chamber can often result in the following problems to the engine: (1) reduction in the operating efficiency of the engine; (2) inhibition in the heat transfer between the combustion chamber and the engine cooling system; and (3) reduction in the volume of the combustion zone which can cause a higher than design compression ratio in the engine. A knocking engine can also result from deposits forming and accumulating in the combustion chamber. A prolonged period of a knocking engine can result in stress fatigue and wear in engine components such as, for example, pistons, connecting rods and bearings.

In view of the foregoing problems associated with, for example, the formation and accumulation of deposits in the combustion chamber and fuel intake and exhaust systems of a two-cycle internal combustion engine, efforts have been made to develop a fuel composition by mixing a fuel and lubricant component together with a third component lubricant additive. Illustrative of these third component lubricant additives are those disclosed in U.S. Pat. Nos. 5,498,353 and 5,888,948.

SUMMARY OF THE INVENTION

In accordance with the present invention, a two-cycle engine fuel composition is provided which comprises (a) a major amount of a two-cycle engine fuel; (b) a lubricant component; and, (c) a two-cycle engine fuel combustion deposit-inhibiting amount of at least one hydrocarbyl polyoxyalkylene aminoalcohol of the general formula

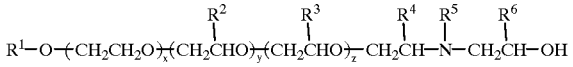

wherein $R^1$ is an alkyl, an alicyclic or an alkylalicyclic radical having from about 4 to about 30 carbon atoms or an alkylaryl where the alkyl group is from about 4 to about 30 carbon atoms; x is an integer from 0 to about 5, y is an integer from 1 to about 49, z is an integer from 1 to about 49 and the sum of x+y+z is equal to 3 to about 50; $R^2$ and $R^3$ each is different and is an alkyl group of from 1 to 4 carbon atoms and each oxyalkylene radical can be any combination of repeating oxyalkylene units to form random or block copolymers; $R^4$ is the same as $R^2$ or $R^3$; $R^5$ is hydrogen or

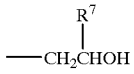

where $R^7$ is hydrogen or an alkyl group of from 1 to 5 carbon atoms; and $R^6$ is hydrogen or an alkyl group of from 1 to 5 carbon atoms.

It shall be understood herein that mixed oxyalkylene groups constituting the polyoxyalkylene chain in the foregoing general formula may contain random or block sequencing.

Further in accordance with this invention, a method for inhibiting the deposition of fuel combustion deposits in a two-cycle engine is provided which comprises operating the two-cycle engine employing as the fuel therefore a two-cycle engine fuel composition which comprises (a) a major amount of a two-cycle engine fuel; (b) a lubricant component; and, (c) a two-cycle engine fuel combustion deposit-inhibiting amount of at least one hydrocarbyl polyoxyalkylene aminoalcohol of the general formula

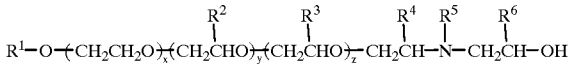

wherein $R^1$, $R^2$, $R^3$, $R^4$, $R^5$, $R^6$, x, y and z have the aforestated meanings.

DESCRIPTION OF THE PREFERRED EMBODIMENTS

The two-cycle engine fuel composition of this invention will inhibit the deposition of fuel combustion deposits in the combustion chamber and intake valves and exhaust system of a two-cycle engine. In general, the fuel composition will contain (a) a major amount of a two-cycle engine fuel; (b) a lubricant component; and, (c) an effective two-cycle engine fuel combustion deposit-inhibiting amount of at least one hydrocarbyl polyoxyalkylene aminoalcohol.

Suitable two-cycle engine fuels for use herein, i.e., gasoline base stocks, ordinarily contain a mixture of hydrocarbons boiling in the gasoline boiling range of from about 90° F. to about 370° F. This fuel can consist of straight or branched chain paraffins, cycloparaffins, olefins, aromatic hydrocarbons, or mixtures thereof. The fuel can be derived from among others, straight run naphtha, polymer gasoline, natural gasoline, or from catalytically cracked or thermally cracked hydrocarbons and catalytically reformed stock. Generally, the composition and octane level of the fuel are not critical and any conventional two-cycle engine fuel can be employed herein.

The lubricant component employed herein can be any lubricating oil used in a two-cycle engine. Suitable lubricating oils for use herein can be any natural oil, synthetic oil or mixtures thereof. Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale and the like.

Useful synthetic lubricating oils include hydrocarbon oils and halo-substituted hydrocarbon oils such as polymerized and interpolymerized olefins, e.g., polybutylenes, polypropylenes, propylene-isobutylene copolymers, chlorinated polybutylenes, etc.; poly(1-hexenes), poly(1-octenes), poly(1-decenes), and the like and mixtures thereof; alkylbenzenes such as dodecylbenzene, tetrade cylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include oils made by polymerizing olefins of less than 5 carbon atoms such as ethylene, propylene, butylenes, isobutene, pentene, and mixtures thereof. Methods of preparing such polymer oils are well known to those skilled in the art.

Further useful synthetic oils include alkylene oxide polymers, i.e., homopolymers, interpolymers, and derivatives thereof where the terminal hydroxyl groups have been modified by esterification or etherification. These oils are exemplified by the oils prepared through polymerization of ethylene oxide or propylene oxide, the alkyl and amyl ethers of these polyoxyalkylene polymers (e.g., methyl poly propylene glycol ether having an average molecular weight of 1,000, diphenyl ether of polyethylene glycol having a molecular weight of 500–1000, diethyl ether of polypropylene glycol having a molecular weight of 1,000–1,500, etc.) or mono- and polycarboxylic esters thereof such as, for example, the acetic esters, mixed $C_3$–$C_8$ fatty acid esters, or the $C_{13}$Oxo acid diester of tetraethylene glycol.

Yet further useful synthetic lubricating oils include the esters of dicarboxylic acids e.g., phthalic acid, succinic acid, alkyl succinic acids, alkenyl succinic acids, maleic acid, azelaic acid, suberic acid, sebacic acid, fumaric acid, adipic aicd, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, de(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from monocarboxylic acids having from about 5 to about 12 carbon atoms and polyols and polyol ethers such as neopentyl glycol, trimethylol propane, pentaerythritol, dipentaerythritol, tripentaerythritol, and the like.

Other useful silicon-based oils include poly-alkyl-, polyaryl-, or polyaryloxy-siloxane oils and silicate oils. Examples of these include tetraethyl silicate, tetra-isopropyl silicate, tetra-(2-ethylhexyl) silicate, tetra-(4-methyl-hexyl) silicate, tetra-(p-tert-butylphenyl)silicate, hexyl-(4-methyl-2-pentoxy)disiloxane, poly(methyl)siloxanes, poly (methylphenyl)siloxanes, poly(methylphenyl)siloxanes, and the like. Other synthetic lubricating oils include liquid esters of phosphorous containing acids, e.g., tricresyl phosphate, trioctyl phosphate, diethyl ester of decane phosphionic acid, etc., polymeric tetrahydrofurans and the like.

Unrefined, refined and rerefined oils, either natural, synthetic or mixtures of two or more of any of these of the type disclosed hereinabove can be used in the fuel composition of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many of these purification techniques are known to those of skill in the art such as solvent extractions, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

In general, the lubricant component of this invention will have a lubricating viscosity (in cSt at 40° C.) ranging from about 10 cSt to about 60 cSt and preferably from about 30 cSt to about 40 cSt. Typically, the lubricant component will be added to the two-cycle engine fuel composition of this invention in an amount ranging from about 1 weight percent to about 6 weight percent, preferably from about 1.5 weight percent to about 2.5 weight percent and more preferably from about 1.7 weight percent to about 2.2 weight percent, based on the weight of the fuel composition.

The hydrocarbyl polyoxalkylene aminoalcohol possesses the general formula

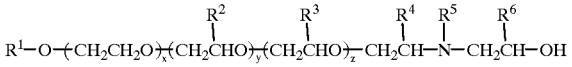

wherein x is an integer from 0 to about 5, y is an integer from 1 to about 49 preferably from about 5, y is an integer from 1 to about 49 preferably from about 5 to about 40 and more preferably from about 5 to about 10, z is an integer from 1 to about 49, preferably from about 5 to about 40 and more preferably from about 5 to about 10 and the sum of x+y+z is equal to 3 to about 50; $R^1$ is an alkyl, an alicyclic or an alkylalicyclic radical having from about 4 to about 30 carbon atoms or an alkylaryl where the alkyl group is from about 4 to about 30 carbon atoms, including by way of illustration, unsubstituted straight or branched aliphatic, cycloaliphatic and aromatic groups and cycloaliphatic and aromatic groups substituted with one or more straight or branched aliphatic, cycloaliphatic and/or aromatic groups. Thus, for example, $R^1$ can be represented by the general formula

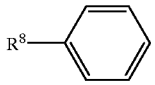

wherein $R^8$ is a hydrocarbyl group of from about 4 to about 30 carbon atoms including, by way of example, a monovalent aliphatic radical having from about 6 to about 24 carbon atoms, preferably from about 8 to about 20 carbon atoms and more preferably from about 9 to about 18 carbon atoms. $R^2$ and $R^3$ each is different and is an alkyl group of from 1 to 4 carbon atoms and each oxyalkylene radical can be any combination of repeating oxyalkylene units to form random or block copolymers with the random copolymers being preferred for use herein; $R^4$ is the same as $R^2$ or $R^3$; $R^5$ is hydrogen or

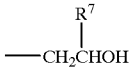

where $R^7$ is hydrogen or an alkyl group of from 1 to 5 carbon atoms; and $R^6$ is hydrogen or an alkyl group of from 1 to 5 carbon atoms. The preferred hydrocarbyl polyoxyalkylene aminoalcohol for use herein as a fuel additive is 4-n-nonylphenoxypoly(propylene oxide-co-butylene oxide)-(2-N-butylalcohol)amine)-1-butyl ether and is represented by the following formula

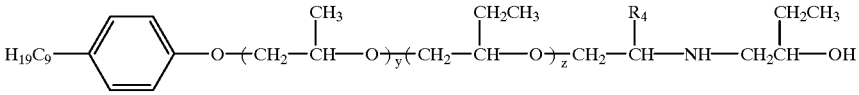

wherein the average value of y is from about 7 to about 8, the average value of z is about half that of y, i.e., from about 3.5 to about 4, with the ratio of y to z being from about 1 to about 3 and preferably from about 1.5 to about 2, $R^4$ is —$CH_3$ or —$CH_2CH_3$ and the sequencing of the propylene oxide/butylene oxide groups are random.

The foregoing hydrocarbyl polyoxyalkylene aminoalcohol can be obtained by reacting a hydrocarbyl polyoxyalkylene amine of the general formula

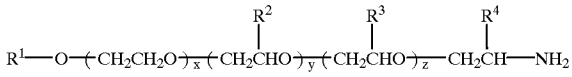

wherein $R^1$, $R^2$, $R^3$, $R^4$, x, y and z have the aforestated meanings with a 1,2-epoxide of the general formula

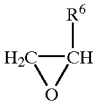

wherein $R^6$ has the aforestated meaning.

Representatives of the hydrocarbyl polyoxyalkylene amine are known in the art, e.g., in U.S. Pat. No. 5,382,942, the contents of which are incorporated by reference herein. In general, the hydrocarbyl polyoxyalkylene amine can be prepared by first reacting an alkylaryl or hydrocarbyl alcohol represented by the general formula

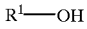

wherein $R^1$ has the aforestated meaning with at least two 1,2-epoxides represented by the general formulae

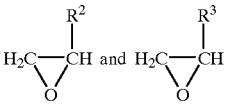

wherein $R^2$ and $R^3$ have the aforestated meanings. Optionally, a small amount of ethylene oxide, e.g., up to about 35 percent, can be added to the foregoing reaction to provide a hydrocarbyl polyoxyalkylene hydroxide represented by the general formula

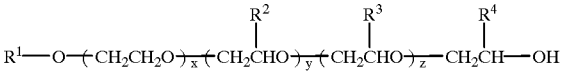

wherein $R^1$, $R^2$, $R^3$, $R^4$, x, y and z have the aforestated meanings. Preferred 1,2-epoxides for use herein include, but are not limited to, ethylene oxide, propylene oxide, butylene oxide and the like.

The hydrocarbyl alcohol and at least two 1,2-epoxides are advantageously reacted to form the hydrocarbyl polyoxyalkylene hydroxide in a mole ratio ordinarily ranging from about 5 to about 30 and preferably from about 10 to about 20. The reaction is ordinarily conducted at a temperature ranging from about 90° C. to about 120° C. and preferably from about 100° C. to about 115° C. The time for preparing the hydrocarbyl polyoxaylkylene hydroxide, under preferred parameters, will generally not exceed 8 hours.

The hydrocarbyl polyoxyalkylene hydroxide is then reacted with ammonia to provide the hydrocarbyl polyoxyalkylene amine. For example, the hydrocarbyl polyoxyalkylene hydroxide can be aminated by reacting the hydroxide with ammonia gas using well established animation methods. In general, the amount of ammonia reacted with the hydrocarbyl polyoxyalkylene hydroxide can range from about 1.0 cc/min to about 3.0 cc/min and preferably from about 1.5 cc/min Oto about 2.5 cc/min. The temperature of this reaction will ordinarily range from about 160° C. to about 209° C. and preferably from about 190° C. to about 208° C.

The hydrocarbyl polyoxyalkylene amine is then reacted with 1,2-epoxide or mixture thereof to form the desired hydrocarbyl polyoxyalkylene aminoalcohol utilized herein. Suitable 1,2-epoxides to react with the hydrocarbyl polyoxyalkylene amine include, but are not limited to, ethylene oxide, propylene oxide, butylene oxide, pentylene oxide, hexylene oxide and heptylene oxide. A preferred 1,2-epoxide for use herein is butylene oxide. Generally, the hydrocarbyl polyoxyalkylene amine and the 1,2-epoxide are advantageously reacted to provide a product mixture containing the product hydrocarbyl polyoxyalkylene aminoalcohol. During this condensation reaction, the predominate product formed in the product mixture is a mono-butoxylated amine. As one skilled in the art will readily appreciate, other products are unavoidably present in the product mixture during this reaction. For example, in addition to providing the predominate mono-butoxylated amine product, the product mixture may contain from about 0.1 weight percent up to about 25 weight percent apiece of (a) unreacted hydrocarbyl polyoxyalkylene amine and/or (b) a di-butoxylated amine.

In general, the 1,2-epoxide is reacted with the hydrocarbyl polyoxyalkylene amine in a mole ratio ranging from about 0.5:1 to about 50:1 and preferably from about 1:1 to about 7:1. An especially advantageous molar ratio is from about 1.0:1.1. The temperature for this reaction will ordinarily range from about 140° C. to about 190° C. and preferably from about I50° C. to about.180° C. The time period for this reaction will typically not exceed 8 hours.

The product hydrocarbyl polyoxyalkylene aminoalcohol can ordinarily be added prior to, simultaneously or after the lubricant component is added to the two-cycle engine fuel. It is also contemplated that the hydrocarbyl polyoxyalkylene aminoalcohol can be directly mixed with the lubricant component to form a two-cycle lubricant formulation and then adding the formulation to the two-cycle engine fuel.

In general, the two-cycle engine fuel combustion deposit-inhibiting amount of the hydrocarbyl polyoxalkylene aminoalcohol employed in the two-cycle engine fuel composition as a fuel additive can range from about 100 to about 2000 pounds per thousand barrels (PTB), preferably from about 500 to about 1100 PTB and more preferably from about 800 to about 1000 PTB.

In the fuel composition, other fuel additives can be employed with the additive of this invention, including, for example, antiknock agents such as tetraethyl lead compounds, anti-icing additives, antioxidants, metal deactivators, demulsifiers and the like.

The following example is illustrative of the two-stroke cycle engine fuel composition of this invention.

EXAMPLE

A. Materials

The fuel composition of this invention was prepared by first mixing a two-cycle engine fuel which consisted of Philips 'J' reference fuel as set forth below with a lubricant component which consisted of ASTM 606 Oil (a reference oil supplied by the ASTM Test Monitoring Center, Pittsburgh, Pa.). The fuel and lubricant component were mixed with a 50:1 wt/wt blend of fuel-to-lubricant, respectively, to form a fuel mixture. Next, the fuel mixture was additized with 9.332 g/gal of the detergent, 4-n-nonylphenoxypoly(propylene oxide-co-butylene oxide)-(2-N-butylalcohol)amine)-1-butyl ether to form the fuel composition.

Experimental Two-Cycle Engine Fuel

| Experimental Two-Cycle Engine Fuel | |
|---|---|
| Test | Characteristic |
| API Gravity @ 80F | 54.2 |
| Cu Corrosion, 3 hr. 1212F | |
| Reid Vapor Pressure | 8.0 |
| Research Octane Number | 96.2 |
| Motor Octane Number | 85.0 |
| Total Sulfur, wt. X | 0.0114 |

-continued

| Experimental Two-Cycle Engine Fuel | |
|---|---|
| Test | Characteristic |
| Existent Gum mg/186 ml | 0.8 |
| Oxidation Stability, Min. | 1,200+ |
| Lead, late than 0.61 mg/gal | 0.001 |
| Distillation, % Evap. | |
| IBP | 94 |
| 10% | 127 |
| 50 | 219 |
| 90% | 329 |
| EP | 432 |
| Recovery, % | 98.2 |
| Hydrocarbon Analysis, Vol. % | |
| Paraffins + Naphthenes | 42.7 |
| Olefins | 15. |
| Aromatics | 42.0 |

B. Test

The Two-Cycle Gasoline Lubricant Evaluation, Y-350M2—Yamaha RD350B Detergent Test ASTM D4857, was used to evaluate detergent effectiveness. Testing was conducted at Southwest Research Institute, San Antonio, Tex. During this 20 hour test, the impact of the detergent on cylinder heads, pistons and rings, cylinder head gaskets, and exhaust gaskets was evaluated. The test was designed so that one of the two cylinders of the two-cycle engine would simultaneously receive fuel additized only with the lubricant component (cylinder 2), while the other cylinder (cylinder 1) simultaneously received fuel additized with the lubricant component and the fuel detergent, i.e, the fuel composition of this invention.

IV. Test Results

Table I set forth below provides a summary of the test results.

TABLE I

| | | Cylinder 1 | Cylinder 2 |
|---|---|---|---|
| Test Information | | | |
| Fuel composition | | Fuel + Oil 606 + Fuel Detergent | Fuel + Oil 606 |
| SwRI Code | | LO-137652 | LO-135250 |
| Fuel/Type | | Phillips 'J' | Phillips 'J' |
| Fuel/Oil Ratio | | 50:1 | 50:1 |
| Engine Inspection | | | |
| Piston Varnish | Thrust | 9.1 | 6.0 |
| | Anti-thrust | 9.1 | 4.9 |
| | Average | 9.1 | 5.4 |
| | Ring Land | 3.8 | 1.6 |
| | Undercrown | 1.0 | 1.0 |
| Wristpin | Varnish | 4.6 | 5.1 |
| | Condition | GOOD | GOOD |
| | Bearing Varnish | 7.3 | 9.1 |
| | Bearing Condition | GOOD | GOOD |
| Cylinder Liner Varnish | | 7.6 | 6.6 |
| Ring Sticking | Top Ring | 10.0 | 10.0 |
| | Second Ring | 9.5 | 7.0 |
| Deposits | Piston Crown | 8.6 | 8.6 |
| | Cylinder Head | 8.2 | 8.4 |
| | Exhaust Port Blocking % | 2.0 | 3.0 |
| | Exhaust Port Blocking | 9.8 | 9.7 |

TABLE I-continued

| | | Cylinder 1 | Cylinder 2 |
|---|---|---|---|
| Piston Scuffing | Thrust | 10.0 | 10.0 |
| | Anti-Thrust | 10.0 | 10.0 |
| Cylinder Liner Wear | | 10.0 | 10.0 |
| CRC Demerit Number | Ring Land | 6.695 | 9.500 |

As these data show, the cylinder receiving the fuel composition of this invention, i.e., cylinder 1, had better results than the cylinder receiving only the fuel and lubricant component, i.e., cylinder 2. For example, cylinder 1 contained fewer deposits in the ring land than cylinder 2 thus receiving a lower CRC demerit number.

What is claimed is:

1. A two-cycle engine fuel composition which comprises (a) a major amount of a two-cycle engine fuel; (b) a lubricant oil component; and, (c) a two-cycle engine fuel combustion deposit-inhibiting amount of at least one hydrocarbyl polyoxyalkylene aminoalcohol of the general formula

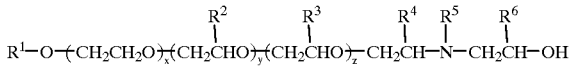

wherein $R^1$ is an alkyl, an alicyclic or an alkylalicyclic radical having from about 4 to about 30 carbon atoms or an alkylaryl where the alkyl group is from about 4 to about 30 carbon atoms; x is an integer from 0 to about 5, y is an integer from 1 to about 49, z is an integer from 1 to about 49 and the sum of x+y+z is equal to 3 to about 50; $R^2$ and $R^3$ each is different and is an alkyl group of from 1 to 4 carbon atoms and each oxyalkylene radical can be any combination of repeating oxyalkylene units to form random or block copolymers; $R^4$ is the same as $R^2$ or $R^3$; $R^5$ is hydrogen or

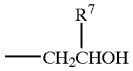

where $R^7$ is hydrogen or an alkyl group of from 1 to 5 carbon atoms and $R^6$ is hydrogen or an alkyl group of from 1 to 5 carbon atoms.

2. The fuel composition of claim 1 wherein the hydrocoarbyl polyoxyalkylene aminoalcohol is present in an amount from about 100 PTB to about 2,000 PTB.

3. The fuel composition of claim 1 wherein the lubricating oil is selected from the group consisting of natural oil, synthetic oil and mixtures thereof.

4. The fuel composition of claim 1 wherein the lubricant component is present in an amount from about 1 to about 6 weight percent based on the weight of the fuel composition.

5. The fuel composition of claim 1 wherein the lubricant component is present in an amount from about 1 to about 6 weight percent based on the weight of the fuel composition.

6. The fuel composition of claim 1 wherein $R^1$ is an alkylaryl where the alkyl group is from about 6 to about 24 carbon atoms.

7. The fuel composition of claim 1 wherein $R^2$ is methyl, $R^3$ is ethyl, $R^5$ is hydrogen and $R^6$ is ethyl.

8. The fuel composition of claim 7 wherein x is equal to 0 and the ratio of y to z is from about 1.5 to about 2.

9. The fuel composition of claim 7 wherein x is equal to 0, the oxyalkylene units are formed as random copolymers and the ratio of y to z is from about 1.5 to about 2.

10. The fuel composition of claim 2 wherein the hydrocarbyl polyoxyalkylene aminoalcohol is present in an amount from about 800 PTB to about 1000 PTB.

11. A method for inhibiting the deposition of fuel combustion deposits in a two-cycle engine which comprises operating the engine employing as a fuel therefore a two-cycle engine fuel composition which comprises (a) a major amount of a two-cycle engine fuel; (b) a lubricant oil component; and, (c) a two-cycle engine fuel combustion deposit-inhibiting amount of at least one hydrocarbyl polyoxyalkylene aminoalcohol of the general formula

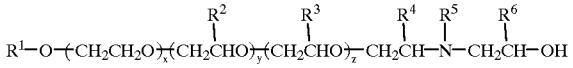

wherein $R^1$ is an alkyl, an alicyclic or an alkylalicyclic radical having from about 4 to about 30 carbon atoms or an alkylaryl where the alkyl group is from about 4 to about 30 carbon atoms; x is an integer from 0 to about 5, y is an integer from 1 to about 49, z is an integer from 1 to about 49 and the sum of x+y+z is equal to 3 to about 50; $R^2$ and $R^3$ each is different and is an alkyl group of from 1 to 4 carbon atoms and each oxyalkylene radical can be any combination of repeating oxyalkylene units to form random or block copolymers; $R^4$ is the same as $R^2$ or $R^3$; $R^5$ is hydrogen or

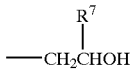

where $R^7$ is hydrogen or an alkyl group of from 1 to 5 carbon atoms and $R^6$ is hydrogen or an alkyl group of from 1 to 5 carbon atoms.

12. The method of claim 11 wherein the lubricating oil is selected from the group consisting of natural oil, synthetic oil and mixture thereof.

13. The method of claim 11 wherein the lubricant component is present is an amount from about 1 to about 6 weight percent based on the weight of the fuel composition.

14. The method of claim 11 wherein the lubricant component is present in an amount from about 1 to about 6 weight percent based on the weight of the fuel composition.

15. The method of claim 11 wherein $R^1$ is a alkylaryl where the alkyl group is from about 6 to about 24 carbon atoms.

16. The method of claim 11 wherein $R^2$ is methyl $R^3$ is ethyl, $R^5$ hydrogen and $R^6$ is ethyl.

17. The method of claim 16 wherein x is equal to 0 and the ratio of y to z is from about 1.5 to about 2.

18. The method of claim 16 wherein x is equal to 0, the oxylkylene units are formed as random copolymers and the ratio of y to z is from about 1.5 to 2.

19. The method of claim 11 wherein the hydrocarbyl polyoxyalkylene aminoalcohol is present in an amount from about 100 PTB to about 2,000 PTB.

20. The method of claim 18 wherein the hydrocarbyl polyoxyalkylene aminoalcohol is present in an amount from about 800 PTB to about 1000 PTB.

* * * * *

UNITED STATES PATENT AND TRADEMARK OFFICE

CERTIFICATE OF CORRECTION

PATENT NO. : 6,346,128 B1
DATED : February 12, 2002
INVENTOR(S) : DeRosa et al.

It is certified that error appears in the above-identified patent and that said Letters Patent is hereby corrected as shown below:

Column 3,
Line 47, change "aicd" to -- acid --.

Column 4,
Line 43, change "polyoxalkylene" to -- polyoxyalkylene --.

Column 6,
Line 42, change "polyoxaylkylene" to -- polyoxyalkylene --.
Line 52, change "O" before the word "to".

Column 7,
Line 16, change "I50°C" to -- 150°C --.
Line 26, change "polyoxalkylene" to -- polyoxyalkene --.

Column 10,
Line 57, change "oxylkylene" to -- oxyalkylene --.

Signed and Sealed this

Twenty-third Day of April, 2002

*Attest:*

*Attesting Officer*

JAMES E. ROGAN
*Director of the United States Patent and Trademark Office*